United States Patent [19]

Gardner

[11] 4,413,828

[45] Nov. 8, 1983

[54] METHOD OF PLAYING A BOARD GAME UTILIZING CARDS

[76] Inventor: Anthony R. Gardner, 436 No. Highland Ave., NE, Atlanta, Ga. 30307

[21] Appl. No.: 361,500

[22] Filed: Mar. 25, 1982

Related U.S. Application Data

[62] Division of Ser. No. 178,138, Aug. 14, 1980, Pat. No. 4,362,302.

[51] Int. Cl.[3] ..... A63F 3/00

[52] U.S. Cl. ..... 273/236

[58] Field of Search ..... 273/236, 259, 277, 278, 273/279

[56] References Cited

U.S. PATENT DOCUMENTS

| | | | |
|---|---|---|---|
| 2,355,785 | 8/1944 | Dorfman | 273/236 X |
| 3,011,789 | 12/1961 | Eliassen et al. | 273/236 X |
| 3,170,697 | 2/1965 | Banks et al. | 273/236 X |

OTHER PUBLICATIONS

"War", *Scarne's Encyclopedia of Games,* John Scarne, ©1973, pp. 360-361.

*Primary Examiner*—Richard C. Pinkham
*Assistant Examiner*—Scott L. Brown
*Attorney, Agent, or Firm*—Jones & Askew

[57] ABSTRACT

A board game in which cards bearing numerical indicia are dealt onto a game board and arranged according to opposing sets of indicia on the playing board defining a plurality of placement locations for receiving the cards, the placement locations including a central leader location and a plurality of supporting locations surrounding the leader location. Two players control cards on opposing sides of the board. A novel game proceeds by conducting contests between the player's leader cards supported by cards in a particular supporting location. Losing cards involved in a contest are removed from the game and play proceeds to further contests.

9 Claims, 1 Drawing Figure

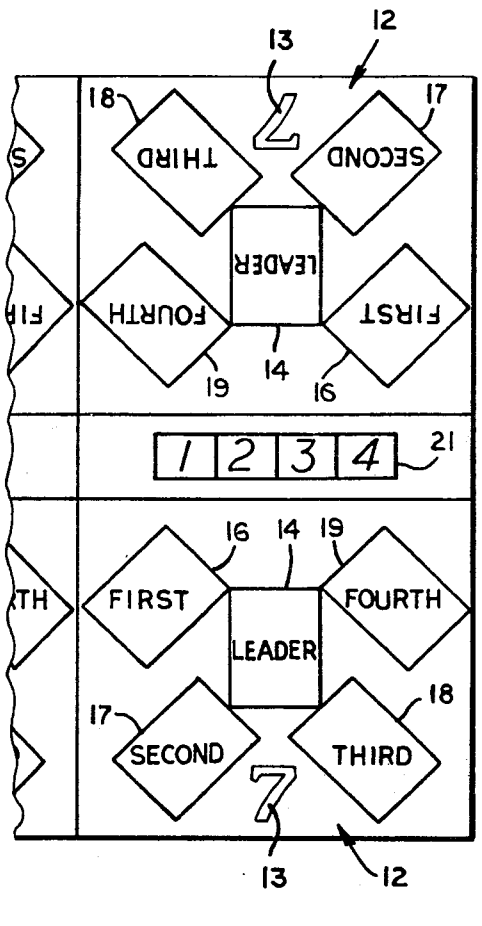
SECOND
FIRST
LEADER
THIRD
FOURTH
1 2 3 4
FOURTH
THIRD
LEADER
FIRST
SECOND
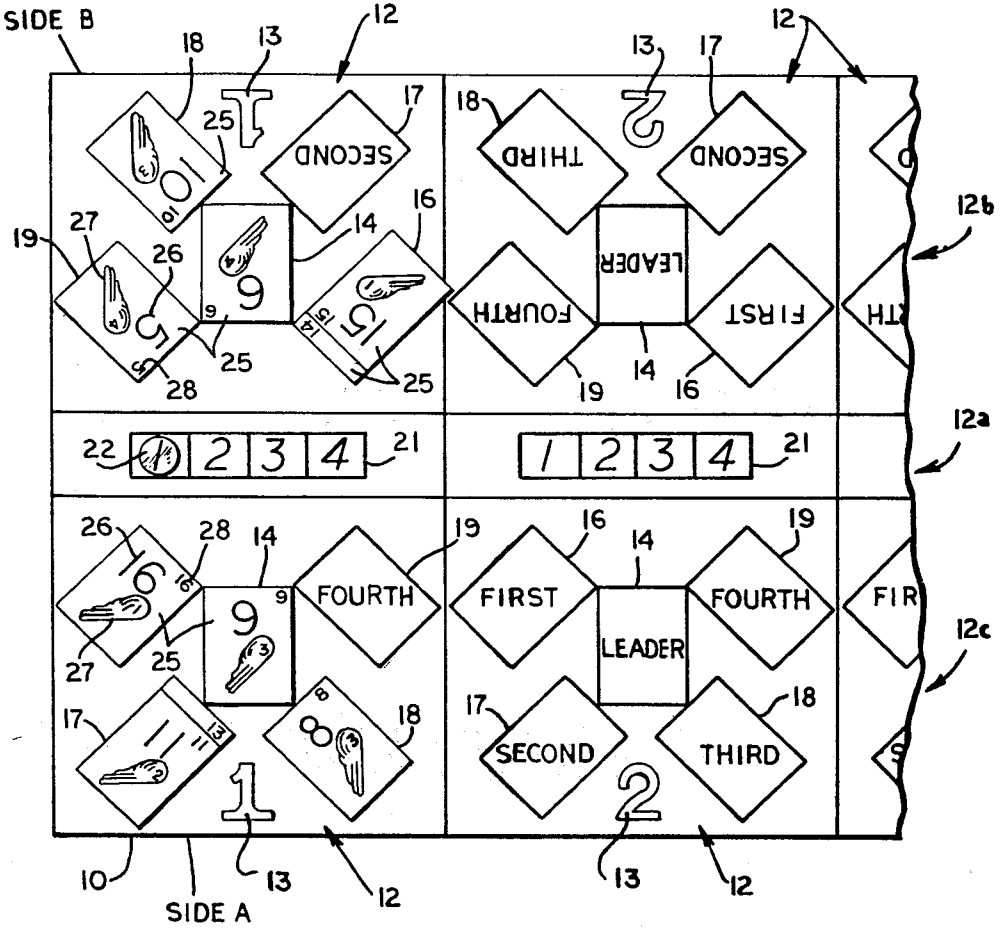
SIDE B
SIDE A
12a
12b
12c
SECOND
FIRST
LEADER
THIRD
FOURTH
1 2 3 4
FOURTH
THIRD
LEADER
FIRST
SECOND

METHOD OF PLAYING A BOARD GAME UTILIZING CARDS

This application is a division of application Ser. No. 178,138, filed Aug. 14, 1980 and now U.S. Pat. No. 4,362,302.

TECHNICAL FIELD

The present invention relates to a game, and more particularly relates to a method for playing a card game and a game board for use in playing the card game.

BACKGROUND ART

Card games utilizing playing cards bearing numerical indicia are well known. Many such card games utilize the standard deck of fifty-two cards. Non-standard cards for playing mathematical card games have also been developed. Examples of such cards and associated games are described in U.S. Pat. No. 1,354,707, U.S. Pat. No. 2,565,702 and U.S. Pat. No. 3,663,021. Prior art games also include board-type card games for simulating popular card games, and a simulator for blackjack is shown in U.S. Pat. No. 3,689,071.

Despite the large number of card games that have been developed and played in the past, none known to the applicant has been similar to the game described herein embodying the present invention.

SUMMARY OF THE INVENTION

The present invention provides a board game comprising a game board defining a playing surface, a plurality of cards bearing numerical indicia thereon, and a pair of opposing sets of indicia on the game board, each defining a plurality of placement locations for receiving the cards, the placement locations including a central location and a plurality of supporting locations adjacent to the central location. The game board preferably includes a series of opposing pairs of such sets of indicia.

The present invention is also a method of playing a card game comprising the steps of first dealing a plurality of cards bearing indicia thereon to each of two opposing posts so as to designate a leader card and one or more cards in one or more of each of a plurality of supporting positions. Then a first contest is conducted by comparing the leader card and any cards present in a first supporting position of one of the two opposing posts with the leader card and any cards present in a first supporting position of the other post to determine a winning post and a losing post for the first contest, and the leader card and cards present in the first supporting position are removed from the losing post. Thereafter a new leader card is selected for the losing post, a second contest is conducted by comparing the leader cards and the cards present in a second supporting position of each of the two posts to determine a winning post and a losing post for the second contest, and the leader card and cards present in the second supporting position are removed from the losing post. Additional contests can be conducted until one of the opposing posts has no cards remaining.

Preferably, the cards are dealt to define a series of pairs of opposing posts, with the parties of cards in each post matched in contests against the parties of cards in the respective opposing posts. In the preferred method, the successive contests are conducted in successive pairs of opposing posts. The cards bear numerical indicia assigning a numerical value to the card and also identifying a particular supporting position with which the card is to be associated.

The method of playing the card game of the invention, the preferred method of scoring and the use of the game board in playing the game are described in detail below.

Thus, it is an object of the present invention to provide a novel card game method combining elements of luck and strategy entertain and challenge players of the game.

It is a further object of the present invention to provide a novel small numbers addition card game method.

Other objects, features and advantages of the present invention will become apparent upon reading the following detailed description of the invention, when taken in conjunction with the accompanying drawing and the appended claims.

BRIEF DESCRIPTION OF THE DRAWING

The FIGURE is a plan view of a board game apparatus embodying the present invention, showing a game board and playing cards in place on a portion of the game board, a portion of the game board being broken away.

DETAILED DESCRIPTION

Referring now in more detail to the drawing, a board game apparatus 10 embodying the present invention is shown. The game board 10 is flat and rectangular. Indicia on the game board 10 define a plurality of stations or columns 12 lying adjacent to one another with each column extending across the width of the board. Labeling indicia 13 are placed at opposite ends of each column 12 adjacent to the longitudinal edge of the board. Preferably, there are seven columns and the labeling indicia 13 are "1" through "7". In the FIGURE, a portion of the game board 10 is broken away so that only columns "1", "2" and "7" are shown in full.

Except for the labeling indicia 13, each of the seven columns 12 is identical. As best shown in the column bearing labeling indicia "2", each column is divided into three sections, a central wing indicator section **12*a* and a pair of opposing posts 12*b* and 12*c* located on opposite sides of the wing indicator section 12*a*. At least two players are required to play the game according to the present invention, one player controlling all of the posts 12*c* along the longitudinal side of the board designated as "SIDE A", and the other player controlling all of the posts 12*b*** along the longitudinal side of the board designated "SIDE B".

Each of the opposing posts **12*b* and 12*c* in a column include indicia for defining the placement of playing cards to be described below. In the central portion of each posts, a leader position 14 is defined bearing the indicium "LEADER". Surrounding the leader position 14 in sequential order are a plurality of supporting positions or "wing" positions, a first wing position 16 bearing the indicium "FIRST", a second wing position 17 bearing the indicium "SECOND", a third wing position 18 bearing the indicium "THIRD", and a fourth wing position 19** bearing an indicium "FOURTH". The indicia "LEADER" and "FIRST", etc. in a particular post face the closest longitudinal edge of the board so that they are legible to the player controlling that post.

In the central wing indicator section **12*a*, a wing indicator indicium 21 is located. The wing indicator indicium 21 includes four blocks containing the numerical indicia "1" through "4". A disc shaped "play now piece" or wing marker 22 is provided to indicate the location of play in a manner that will become clear from the following description of the game. The marker 22** is preferably of transparent material, such as plastic, so that the numerical indicium beneath the marker can be read by the players.

The board game apparatus embodying the present invention also includes a plurality of playing cards 25. Several cards 25 bearing indicia necessary for playing the game according to the invention are shown in place in the column "1". The cards 25 are shown face up, the opposite side of the cards being blank or bearing indicia having no relation to the playing of the game. Each card bears an indicium 26 indicating the numerical value of the card. The numerical value is repeated at an indicium 28 in an upper corner of the card so that the numerical value can be determined when another card is resting on top of the card in question. Finally, each card bears a wing indicium 27 comprising a representation of a wing surrounding a number designating the wing position in which that card must be placed in any post to which the card is dealt.

Two decks of cards are provided for playing the game according to the invention, the cards of each deck bearing a distinguishing color or other marking so that the cards of one deck are dealt to one player and the cards of the other deck are dealt to the other player. Other than such distinguishing color or marking, the decks are identical. The preferred composition of each deck for playing the game according to the invention on the game board shown is as follows:

| Value | Wing Position | Number in Deck |
|---|---|---|
| 16 | 1 | 2 |
| 15 | 1 | 2 |
| 14 | 1 | 2 |
| 13 | 2 | 2 |
| 12 | 2 | 2 |
| 11 | 2 | 2 |
| 10 | 3 | 2 |
| 9 | 3 | 2 |
| 8 | 3 | 2 |
| 7 | 4 | 2 |
| 6 | 4 | 2 |
| 5 | 4 | 3 |
| 4 | 4 | 4 |

In addition to the two decks, a separate single automatic leader card with a value of twenty is provided for use at a certain point in the playing of the game that will be indicated below.

Preparatory to the beginning of play, the cards of each deck are shuffled and dealt. The cards of one deck are dealt face down to the posts **12*c* along one edge of the game board controlled by player A, five cards to column 1 and four cards each to columns 2–7. The other deck is similarly dealt face down to player B. One player (here assume player A) is designated as the offensive team for the initial period of play which is designated a "half-round". Placement of the cards in the positions defined on the board is begun by the offensive player. He or she starts in his or her post 12*c* of column 1 and turns the cards dealt to that post face up. The cards are placed in their appropriate wing positions 16–19 according to the value of each card, with cards of 14–16 value placed face up on wing position 16, cards of 11–13 value placed face up on wing position 17, cards of 8–10 value placed face up on wing position 18, and cards of 4–7 value placed face up on wing position 19, as indicated above. Any one of the cards desired by the player is selected to be the leader card in the leader position 14. The offensive layer continues to place the cards and select leader cards in his or her posts in columns 2–7, and when the offensive team is completely set up, the defensive player places the cards of his or her posts in the same manner. The group of cards at any time occupying a post 12*c* or 12*b*** is designated a "party".

By comparing the cards shown in position in column 1 with the table after a hypothetical deal of the cards to both players, it will be seen that in post **12*b* (controlled by player B), cards of value 14 and 15 are placed in the first wing position 16. No cards having values assigned to the second wing position 17 have been dealt to this post, so the second wing position 17 is vacant. A card of value 10 has been placed in the third wing position 18. A card of value 5 has been placed in the fourth wing position 19. A card of value 6 has been selected from the fourth wing position 19 to become the leader card and is therefore placed in the leader position 14. In the post 12*c* of column 1 (controlled by player A), the placement of cards is similarly done according to the above table, with one card selected to be placed in the leader position 14**.

After positioning of the cards by the players after the deal, play proceeds in the form of a series of contests between the players in a predetermined manner. Play starts in column 1 and in the first wing position, and therefore the transparent disc shaped marker 22 is placed over the number "1" of the wing indicator indicium 21 of column 1. The first contest matches the total value of the leader card and the cards in the first wing position 16 in the player's respective posts **12*b* and 12*c* of column 1. The party with the largest total is the winning party. The leader card and cards in the first wing position 16** of the losing party are removed from the board for the remainder of the half-round. If the totals are equal, the contest is a tie and no cards are removed.

For example, assuming that the cards shown in column 1 were dealt to the players, the first contest in the first wing position matches player B on side B of the game board with a leader card of value 6 plus two cards in the first wing position of values 14 and 15 for a total of 35, against player A on side A of the game board with a card in the leader position of value 9 plus only one card of value 16 in the first wing position for a total of 25. Therefore player B wins the first contest and the cards with values 9 and 16 are removed from the losing player's party in column 1.

Play advances to column 2 for the second contest between the players, and the second contest occurs in the second wing position 17. The marker 22 is moved from column 1 to the wing indicator indicium 21 in column 2 and placed on the numeral "2" to indicate the position of the contest. By this sequential movement of the marker 22, the players are assisted in remembering where the next contest is to occur. The second contest is essentially similar to the first, with the respective parties' leader and second wing cards being totaled and compared. Again, the losing party with the lesser total loses the leader and second wing cards.

Play proceeds with a contest in column 3 in the third wing position 18, and then in column 4 in the fourth wing position 19. At column 5, play reverts back to the first wing position 16. The next contest is in column 6 in the second wing position 17, and the next contest is in column 7 in the third wing position, completing the first sequence of play.

Play then returns to column 1 for a contest in the fourth wing. Since the leader card of the losing party of the first contest in the first column was removed, the player controlling that party selects one of the remaining cards to be the leader card and transfers the selected card to the leader position 14. A contest is conducted, losing cards are removed, and play proceeds to the next contest in column 2 in the first wing position 16. As each column is reached in the second sequence of play new leader cards are selected for parties that lost contests in the previous sequence of play, except in cases where the previous contest in that column resulted in a tie.

After each sequence of play the board must be examined to determine whether any parties of cards in either of the players' posts have been completely removed from the board. If so, the players must make "movements" of the remaining parties of cards in the following manner. When a post is empty at the beginning of a sequence of play, the parties of cards in that player's posts having higher labeling indicia 13 than the vacant post must be shifted to lower numbered columns until there are no empty posts between occupied posts. This results in vacancies in the highest numbered columns. During the following sequence of play, one player may have cards remaining, for example, in column 7, while the opposing player may have shifted his cards originally dealt into column 7 down to column 6 during a movement. If this is the case, the sequence of play ends after a contest in column 6. No contest takes place in column 7, and the wing marker 22 is not advanced on account of column 7. The next sequence of play begins a column 1 in the supporting position immediately succeeding the position in which the contest in column 6 was held. In the case of the player having the "idle" party in column 7, no new leader card is selected for that party if it lost a contest in the preceding sequence of play.

As an example of a required movement, if the cards of player A are totally removed from the fifth column during a sequence of play, then at the end of that sequence the sixth column party of player A must be moved to column 5, and the seventh column party of player A must be moved to column 6. If a player loses high column 1 party, he or she must move all remaining parties after the sequence of play is completed. Parties cannot be moved during a sequence, but must be moved at the beginning at a sequence. There is no limit on the number of posts a moving party may cross in any movement, since movements depend solely on vacant posts. Before the beginning of each sequence of play in column 1, all parties remaining must be as close to column 1 as possible. The leader status of a party of cards does not change during a movement.

It will be seen that as the game proceeds and movements occur, the number of columns involved in each sequence of play will vary, depending on the outcome of the contests in the preceding sequence of play. All "idle" parties are treated as described above. Thus, a sequence of play is a series of contests beginning at column 1 and ending at the highest numbered column occupied by both players.

Successive sequences of play continue until one of the players has no cards remaining in the posts under her or his control. Alternatively, the remaining cards in opposing posts may define a standoff because no additional contests could result in anything but a tie. At this point play has reached the end of the first half-round.

With respect to contests, one of the wing positions may be vacant, and in this case the leader card contests the opposing party along. If a party has only one card remaining it must become the leader card with no wing support. If, following a movement, a contest occurs between two formerly losing parties without leaders, the offensive player must choose a leader card first. A card selected by a player as a leader card remains so until removed after a contest or the end of a half-round. No combination of parties from different posts is permitted.

A full round is completed by repeating the steps described for the first half-round with the offensive and defensive roles switched. A complete game preferably includes three full rounds in each of which each player is the offensive and the defensive team in one of the half-rounds. Scoring is as follows. If, at the end of a half-round, parties of the offensive player remain, the offensive player scores one point for every standing party. If, at the end of a half-round, parties of the defensive player remain, the defensive player scores one point for every remaining party in excess of two. In the preferred method of scoring, the number of cards remaining within any party does not affect the scoring.

For the second, round and the third round, the automatic leader card with a value of 20 is shuffled into the deck of cards to be dealt to the offensive team. Since this deck has one additional card, five cards are dealt to the offensive player's post in column 2 as well as in column 1. The automatic leader card must become the leader of the party into which it is dealt. The automatic leader card stands as any other leader card in a contest, and is removed if defeated.

After three rounds of play, the scores for each round are totaled to determine the winner of the game.

It will be seen that the game of the present invention conducted according to the foregoing rules is both entertaining and challenging. Elements of strategy enter into the play in making leader selections with a view to both the immediate contest at hand and the contest that will follow in the same column during the next sequence of play. A player can sacrifice weak cards during one contest to set up a strong leader and wing support situation during the next sequence of play, since it is known in which wing position the next contest will be. Sacrifices of entire parties can be used to set up favorable movement of strong parties, or to shorten the following sequence of play to cause a future contest in a particular column to be held in a desired supporting position.

Although the foregoing rules for conducting play in the preferred manner are detailed, it will be understood that many variations in the rules and in the board game apparatus could be made within the broad concept of the present invention. To list only a few of the possible variations, the number and value of the cards could be altered, the number of columns could be increased or decreased, the number of wing supporting positions could be increased or decreased, the type of comparison between the cards in the leader and wing positions could be varied, and the type of indicia placed upon the cards to determine their value could be other than numerical indicia. For example, mathematical functions other than addition could be used to compare the cards. Or, a hierarchy of non-numerical indicia such as jack, queen, king, ace could be placed upon the cards and rules established to determine which party would prevail in contests. More than two players can play the game by dividing into teams and assigning team members responsibility for certain posts or parties.

Thus, while this invention has been described in detail with particular reference to a preferred embodiment thereof, it will be understood that variations and modifications can be effected within the spirit and scope of the invention as described hereinbefore and as defined in the appended claims.

I claim:

1. A method of playing a card game comprising the steps of:

dealing a plurality of cards each bearing an indicium thereon to each of two opposing posts so as to designate a leader card and one or more cards in one or more of each of a plurality of supporting positions;

conducting a first contest by comparing the leader card and any cards present in a first supporting position of one of said posts with the leader card and any cards present in a first supporting position of the other of said posts to determine a winning post and a losing post for said first contest;

removing from said losing post said leader card and cards present in said first supporting position;

selecting a new leader card for said losing posts;

conducting a second contest by comparing the leader cards and cards present in a second supporting position of said two posts to determine a winning post and a losing post for said second contest; and removing from said losing post said leader card and cards present in said second supporting position.

2. The method of claim 1 further comprising the steps of continuing to sequentially select leader cards and conduct contests in said remaining supporting positions and thereafter repeating said sequence of contests beginning with said first supporting position, until no cards remain at one of said posts.

3. The method of claim 1 wherein said new leader card is selected from one of the supporting positions of said losing post.

4. The method of claim 1 wherein said indicia on said cards are numerical inidicia and wherein said comparison of cards in said contests is a mathematical comparison.

5. The method of claim 4 wherein each card is dealt only to a predetermined supporting position according to the numerical indicium on said card.

6. The method of claim 4 wherein said steps of mathematically comparing the leader cards and cards present in a supporting position comprise adding the numerical indicia on said leader card and cards present in said supporting position for each posts, the post with the lower numerical sum being the losing post.

7. A method of playing a card game comprising the steps of:

(1) dealing a plurality of cards bearing numerical indicia thereon to a plurality of sequentially numbered stations, so as to form two opposing posts on opposite sides of each station, each post having a designated leader card and one or more cards in selected ones of a plurality of supporting positions;

(2) conducting a first contest in a first station by mathematically comparing the leader card and cards in a first supporting position of one of said posts of said first station with the leader card and cards in a first supporting position of the other of said posts in said first station to determine a winning post and a losing post for said first contest;

(3) removing from said losing post in said first station said leader card and cards present in said first supporting position;

(4) conducting a second contest in a second station by mathematically comparing the leader card and cards present in a second supporting position of one of said posts in said second station with the leader card and cards in a second supporting position of the other of said posts in said second station to determine a winning posts and a losing post for said second contest;

(5) continuing in a sequential manner to conduct contests in the next sequential supporting position of the next sequential station until contests have been conducted in each of said stations;

(6) selecting new leader cards for said losing posts in each of said stations;

(7) responsive to no cards remaining in any post, moving all posts along the same side of said stations as said empty post toward said first station until no empty posts remain except at the end of said sequence of stations;

(8) repeating steps (2)–(7) until no cards remain in any of the posts along one side of said stations.

8. The method of claim 7 further comprising the steps of:

(9) assigning a score to the side along which cards remain;

(10) collecting all of the cards; and

(11) repeating steps (1)–(9).

9. The method of claim 8 wherein said steps of mathematically comparing leader cards and cards in supporting positions comprise adding said numerical indicia on said cards.

* * * * *